US011827405B2

(12) United States Patent
Griffith et al.

(10) Patent No.: US 11,827,405 B2
(45) Date of Patent: Nov. 28, 2023

(54) METHOD AND APPARATUS FOR REMOVING GOODS FROM A TWO-PART CARTON

(71) Applicant: VISY R & D PTY LTD, Campbellfield (AU)

(72) Inventors: Michael William Griffith, Campbellfield (AU); Kaine Michael Cole, Campbellfield (AU); Derek Ian Campbell Ford, Campbellfield (AU); Matthew Stevens, Campbellfield (AU)

(73) Assignee: VISY R & D PTY LTD, Campbellfield (AU)

( * ) Notice: Subject to any disclaimer, the term of this patent is extended or adjusted under 35 U.S.C. 154(b) by 27 days.

(21) Appl. No.: 17/442,000

(22) PCT Filed: Aug. 7, 2020

(86) PCT No.: PCT/AU2020/050821

§ 371 (c)(1),
(2) Date: Sep. 22, 2021

(87) PCT Pub. No.: WO2021/026594

PCT Pub. Date: Feb. 18, 2021

(65) Prior Publication Data

US 2022/0274730 A1 Sep. 1, 2022

(30) Foreign Application Priority Data

Aug. 9, 2019 (AU) ..... 2019902855

(51) Int. Cl.
*B65B 69/00* (2006.01)

(52) U.S. Cl.
CPC ..... *B65B 69/0033* (2013.01)

(58) Field of Classification Search
CPC ..... B65B 69/0033
See application file for complete search history.

(56) References Cited

U.S. PATENT DOCUMENTS 3,757,973 A * 9/1973 Lambert ..... B65B 69/0008 414/412
3,889,442 A * 6/1975 Grahn ..... B65B 43/38 414/412

(Continued)

FOREIGN PATENT DOCUMENTS

| | | |
|---|---|---|
| JP | H06286739 | 10/1994 |
| KR | 10-2017-0054871 | 5/2017 |
| WO | WO 2007/067947 | 6/2007 |

OTHER PUBLICATIONS

International Search Report on corresponding PCT application (PCT/AU2020/050821) from International Searching Authority (AU Patent Office) dated Nov. 11, 2020.

(Continued)

*Primary Examiner* — Glenn F Myers
(74) *Attorney, Agent, or Firm* — KOS IP Law LLP

(57) ABSTRACT

An apparatus for removing goods from a two-part carton having a base and a lid, the base being formed with side walls having external gussets secured against external side faces of the carton, the apparatus including: a lid removal module for engaging the lid and removing it from the carton; expansion members configured to be advanced between the gussets and the external side faces of the carton to remove the gussets from the side faces; engagement members for engaging side walls of the base and drawing them away from the goods and holding them in a position away from the goods; and a goods transfer module for engaging the goods and removing them from the carton.

17 Claims, 9 Drawing Sheets

(56) References Cited

U.S. PATENT DOCUMENTS 3,922,778 A * 12/1975 Aalpoel ..... B65B 69/0033
83/425.2
4,843,801 A * 7/1989 Roncero ..... B65B 69/0033
53/381.2
5,181,652 A 1/1993 Tanttu et al.

OTHER PUBLICATIONS

Written Opinion on corresponding PCT application (PCT/AU2020/050821) from International Searching Authority (AU Patent Office) dated Nov. 11, 2020.

* cited by examiner

Section C-C

Section A-A

Section B-B

METHOD AND APPARATUS FOR REMOVING GOODS FROM A TWO-PART CARTON

CROSS-REFERENCE TO RELATED APPLICATION

This application is the National Phase, under 35 U.S.C. § 371(c), of International Application No. PCT/AU2020/050821, filed Aug. 7, 2020, which claims priority from Australian Application No. AU 2019902855, filed Aug. 9, 2019. The disclosures of all of the referenced applications are incorporated herein by reference in their entirety.

FEDERALLY SPONSORED RESEARCH OR DEVELOPMENT

Not Applicable

FIELD OF THE INVENTION

The present invention relates to a method and apparatus for removing goods from a carton, such as a block of frozen meat or seafood for example.

BACKGROUND

For the transportation of perishable goods, it has been proposed to use cartons formed of a combination of barrier papers and board so that liners such as polyethylene bags can be avoided as they can become entrapped in the goods when frozen, potentially contaminating the goods.

Australian patent application no. 2016225886 discloses such a carton. It can be seen from this disclosure that the carton is folded in a unique way to prevent contact between the raw side edges of the carton and the goods. In particular, the carton is formed with external gussets that are secured to an external side of the carton.

Australian patent application no. 2017204053 discloses a machine for erecting such a carton. It can be seen that the nature of the carton presents challenges for using such a carton.

It is desirable to provide an automated machine for decartoning or removing goods from such a carton. Presently, removal of goods from such a carton is performed manually, which is labour intensive, susceptible to process error and can lead to injury.

One particular issue with removing goods from such a carton arises due to the goods being stuck to carton and somewhat difficult to remove. Another issue is that the goods may be partially defrosted, which can lead to a soggy carton that tears easily and which can lead to contamination of the goods.

There is a need to address the above, and/or at least provide a useful alternative.

SUMMARY

According to one aspect of the invention, there is provided an apparatus for removing goods from a two-part carton having a base and a lid, the base being formed with side walls having external gussets secured against external side faces of the carton, the apparatus including:

a lid removal module for engaging the lid and removing it from the carton;

expansion members configured to be advanced between the gussets and the external side faces of the carton to remove the gussets from the side faces;

engagement members for engaging side walls of the base and drawing them away from the goods and holding them in a position away from the goods; and a goods transfer module for engaging the goods and removing them from the carton.

According to another aspect of the present invention there is provided an apparatus for removing goods from a two-part carton having a base and a lid, the lid being formed with flaps extending downwardly therefrom and the base being formed with side walls having externally folded down upper portions and external gussets secured against external side faces of the carton, wherein the flaps of the lid are secured to the folded down upper portions of the base, the apparatus including:

slitters for cutting along sides of the carton to cut through the flaps of the lid and partially into the folded down upper portions of the base;

a lid removal module for engaging the lid and removing it from the carton;

expansion members configured to be advanced between the gussets and the external side faces of the carton to remove the gussets from the side faces;

engagement members for engaging side walls of the base and drawing them away from the goods and holding them in a position away from the goods; and a goods transfer module for engaging the goods and removing them from the carton.

According to preferred embodiments of the invention, the expansion members are wedges. Preferably, the expansion members are driven upwardly from below the carton.

The engagement members can include suction cups configured to engage a first pair of side walls of the carton, the first pair of side walls are generally parallel with a path of travel of the carton. The engagement members can include rods that extend downwardly to engage a second pair of side walls of the carton to draw them away from the goods, the rods pinning the second pair of side walls against a transfer conveyor to hold them in position.

Preferably, the goods transfer module includes fingers configured to pierce the goods for engagement thereof. Preferably, the goods transfer module is configured to tilt the goods and release them from the carton.

The slitters may be fixed in position and include spring loaded blades that follow the contour of the carton. The apparatus can further include at least one conveyor belt for transporting the carton through the apparatus, the conveyor belt/belts moving the goods between an initial position, a lid removal station, and a goods removal station.

Preferably, the slitters contact the first pair of side walls of the carton during movement from the initial position to the lid removal station. The slitters may contact the second pair of side walls of the carton when positioned at the lid removal station. Preferably, the slitters for contacting the second pair of side walls of the carton are fixed to the lid removal module.

In preferred embodiments, the carton moves in a generally straight path and the lid removal module moves perpendicular to the path of movement of the carton. Once the goods are removed from the carton, the empty carton is preferably transported along a further conveyor disposed perpendicular to the at least one conveyor belt. Preferably, the lid removal module engages the lid with suction cups.

Preferred embodiments further include an imaging system configured for scanning an internal surface of the base and/or lid of the carton once the goods are removed, the imaging system configured to identify missing carton fragments that may be attached to the goods.

According to another aspect of the invention there is provided a method of removing goods from a two-part carton having a base and a lid, the lid being formed with flaps extending downwardly therefrom and the base being formed with side walls having folded down upper portions and external gussets secured against external side faces of the carton, including the steps of:

slitting sides of the carton to cut through the flaps of the lid and partially into the folded down upper portions of the base;

removing the lid;

driving expansion members between the gussets and the side faces to remove the gussets from the side faces;

drawing side walls of the carton away from the goods; and engaging the goods and lifting them from the carton.

In preferred embodiments, the goods are tilted to release them from the carton.

Preferably, the expansion members are wedges driven upwardly from underneath the carton.

The method can further include the step of using an imaging system to scan an inside surface of the carton after the goods have been removed to check for missing fragments.

BRIEF DESCRIPTION OF THE DRAWINGS

In order that the invention may be more easily understood, an embodiment will now be described, by way of example only, with reference to the accompanying drawings, in which.

DETAILED DESCRIPTION

Figure 1:
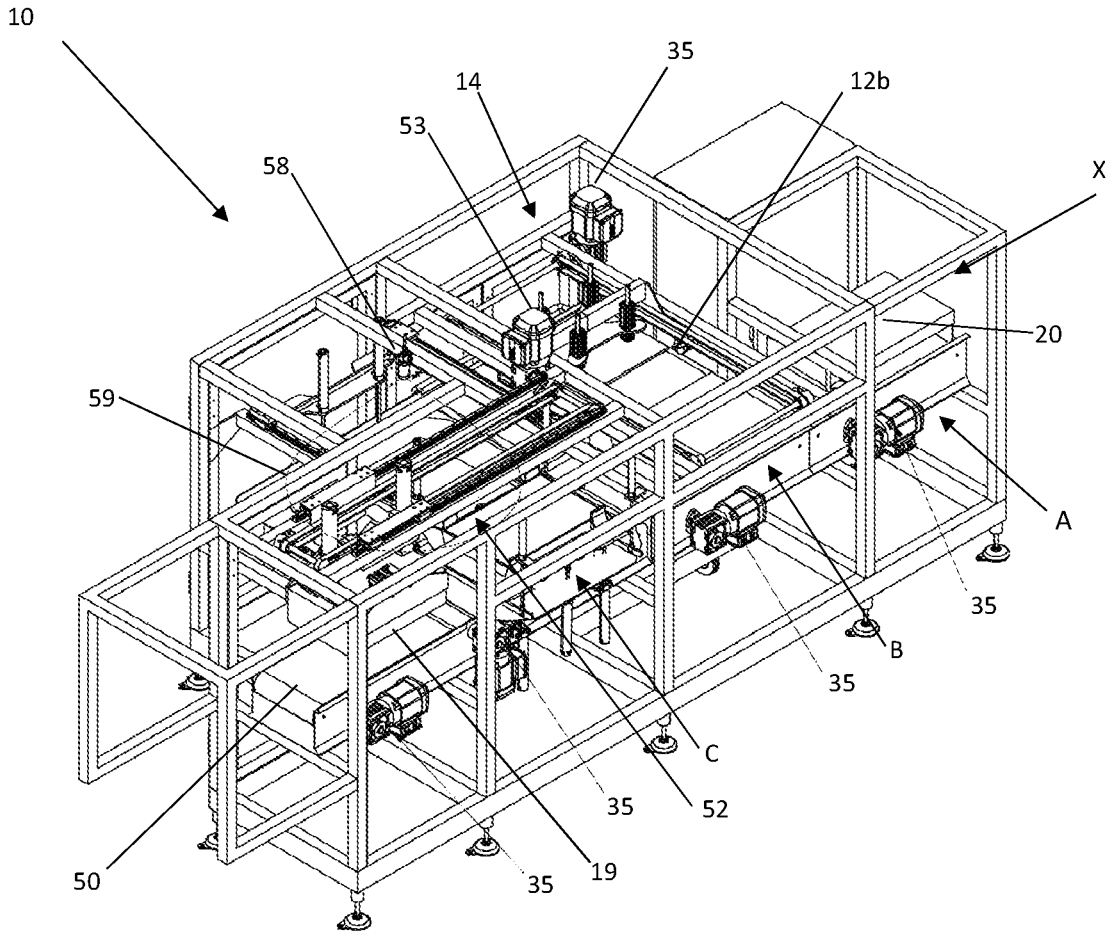
FIG. 1 is a front perspective view of an apparatus for removing goods from a two-part carton according to a preferred embodiment of the invention.

An apparatus 10 according to a preferred embodiment of the invention is shown in FIG. 1. The apparatus 10 is configured for removing goods from a two-part carton 20 such as that shown in FIG. 2, or carton 20*a* of FIG. 3.

Figure 2:
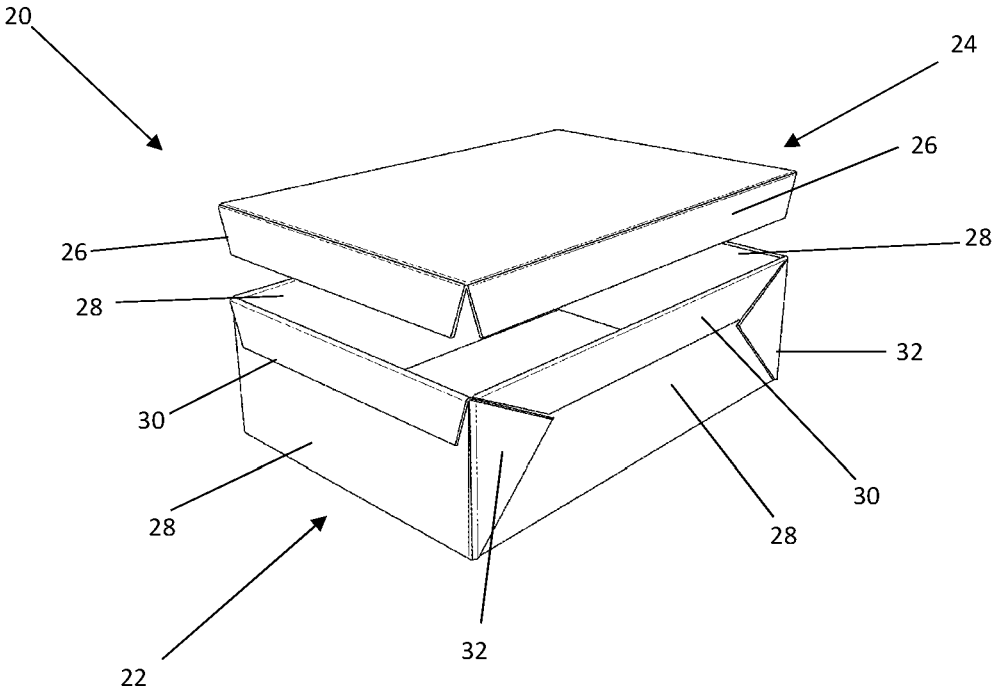
FIG. 2 is an exploded perspective view of a carton for use with the apparatus of FIG. 1.
Figure 3:
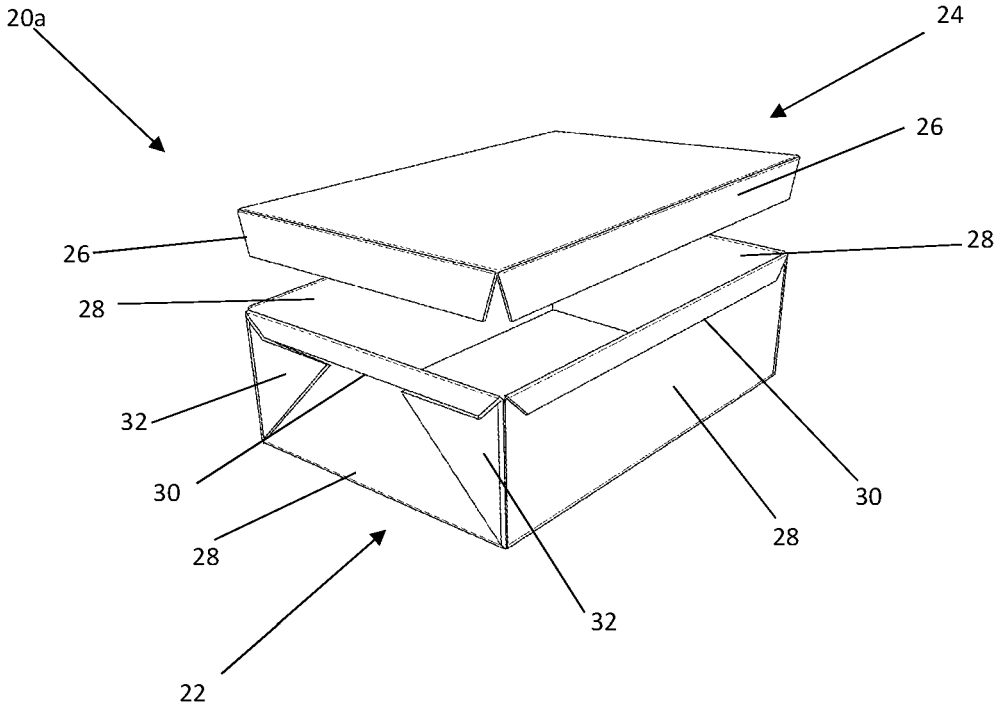
FIG. 3 is an exploded perspective view of another carton for use with the apparatus of FIG. 1.

As illustrated in FIGS. 2 and 3, cartons 20, 20*a* have a base 22 and a lid 24. The lid 24 is formed with flaps 26 extending downwardly therefrom and the base 22 is formed with side walls 28 having externally folded down upper portions 30 and external gussets 32 secured against external side faces of the carton 20. In use, the flaps 26 of the lid 24 are secured to the folded down upper portions 30 of the base 22.

Carton 20 may be configured as per that described in Australian provisional patent application no. 2015903825, and its corresponding related applications, the entire contents of which are incorporated herein by reference. Although the carton is shown as being rectangular, those skilled in the art will appreciate that the carton may take other shapes, such as a square for example, and have other proportions. Furthermore, lid 24 may take other forms, having side walls 26 that extend over substantially the entire side of the carton 20. Preferably, the corners of the lid 24 are trimmed as shown, to facilitate removal, though it will also be appreciated that such trimming may be omitted.

Also, in FIG. 2 gussets 32 are shown as being folded down over the long side walls, forming a leak proof flap along that side, though the gussets may also be folded down over the short side walls, as shown in relation to FIG. 3. It will be appreciated that the form of side flaps 30 will vary according to whether the gussets fold down on the short side or long side of the carton.

Apparatus 10 includes slitters 12*a* (FIGS. 4, 6, 7, 10 and 13) and 12*b* (FIGS. 1, 4, 6, 7, 10, 12 and 13) for cutting along sides of the carton to cut through the flaps 26 of the lid 24 and partially into the folded down upper portions 30 of the base 22, a lid removal module 14 for engaging the lid 24 and removing it from the carton 20, expansion members 16 (FIGS. 5, 6, 7, 12, 13 and 15) configured to be received between the gussets 32 and the external side faces of the side walls 28 of the carton 20 to remove or detach the gussets from the side faces, engagement members 18 (FIGS. 5, 6, 7, 12, 13 and 15) for engaging the side walls 28 of the base 22 and drawing them away from the goods and holding them in a position away from the goods, and a goods transfer module 19 (FIGS. 1, 4, 7, 8, 9 and 14) for engaging the goods and removing them from the carton.

In alternative embodiments, lid 24 is not glued to base 22 but secured with other means, such as straps extending around the outer surface of the carton 20 for example. In such embodiments, the straps may be cut manually before the carton is loaded into the apparatus 10, or may alternatively be removed by an automated de-strapping device located at entry point A.

In the described embodiments, the contents of the carton are goods in the form of a solid block. The goods may be in a singular piece or multiple individual pieces. In preferred embodiments, the goods are a frozen block of foodstuffs, and preferably meat or seafood products, though those skilled in the art will appreciate that the goods may also be dairy products such as cheese, or produce such as fruit or vegetable products, that may or may not be frozen, for example.

Figure 4:
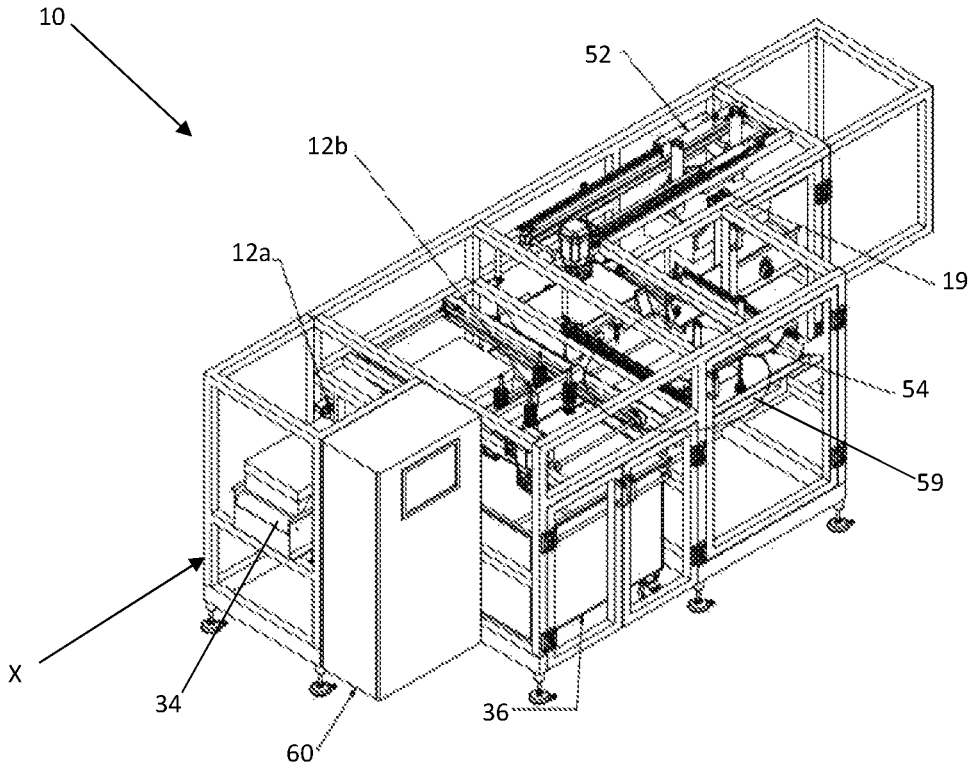
FIG. 4 is a rear perspective view of the apparatus.
Figure 7:
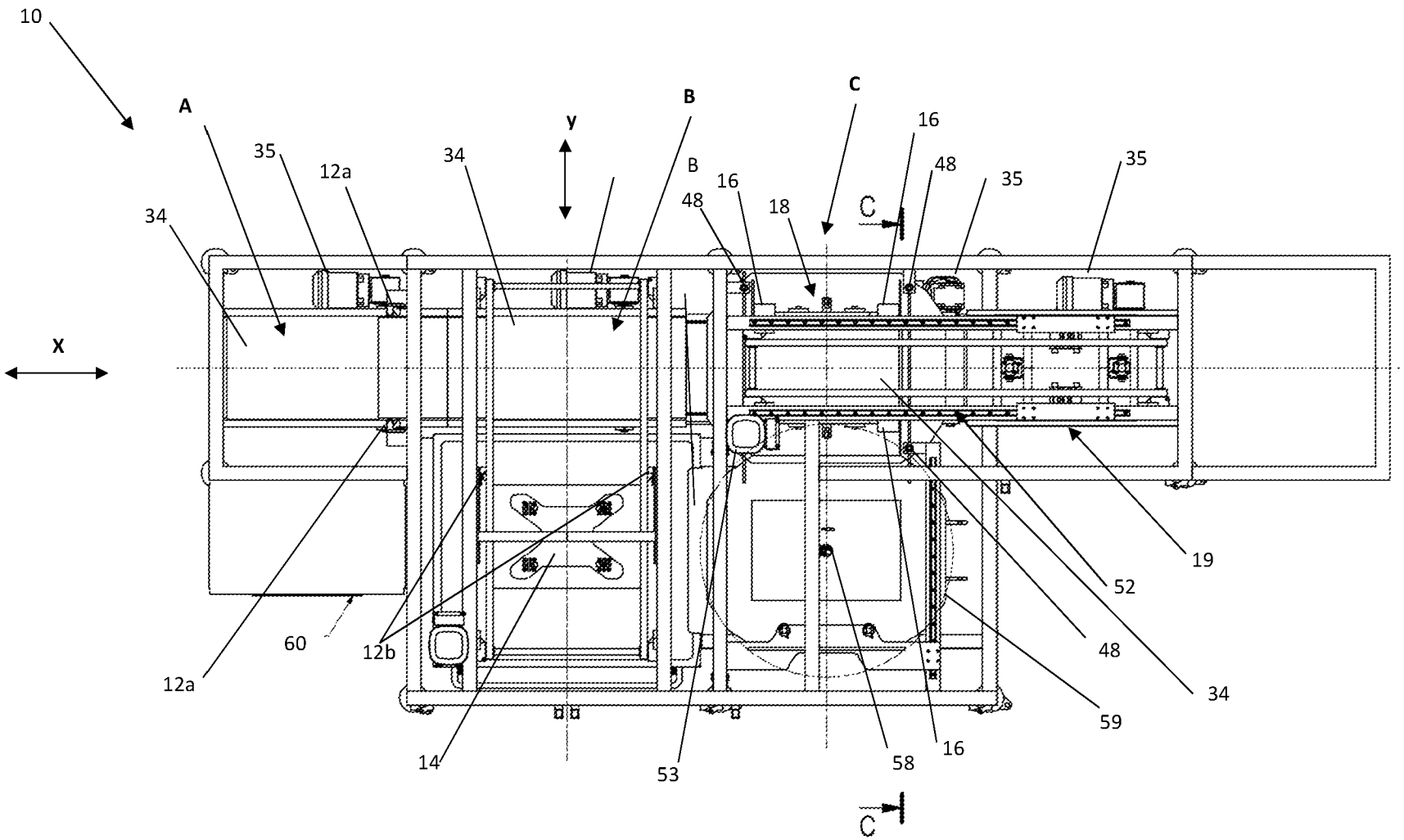
FIG. 7 is a plan view of the apparatus.
Figure 8:
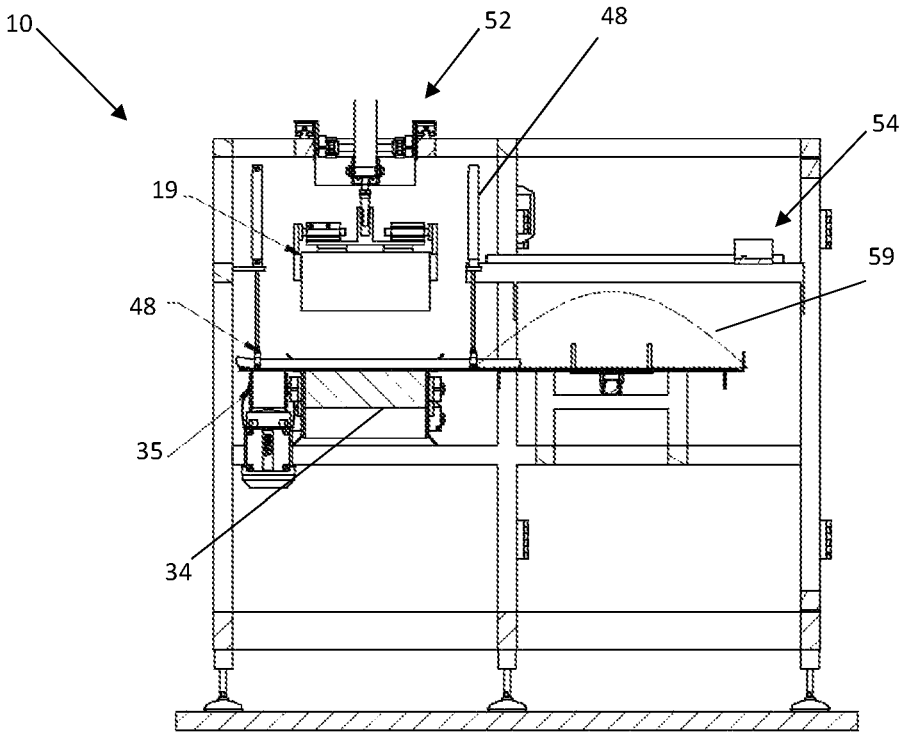
FIG. 8 is a section view of the apparatus, showing a section taken along line C-C of FIG. 7.

Apparatus 10 includes a conveyor belt 34 (FIGS. 4, 7, 8, 9, 10, 11, 12, 13 and 15) to move carton 20 along a generally straight path indicated as X in FIGS. 1, 4 and 7. It will be appreciated that the conveyor belt 34 may be a single belt or made up of multiple sections of conveyor belt.

In the described embodiments, carton 20 move along its longitudinal axis or long ways, though it will be appreciated that the carton 20 may also move along a transverse axis or sideways.

As can be seen in FIG. 7, the carton 20 starts at an initial position A and moves from there to a lid removal station B, and then to a goods removal station C, each of which will be described in further detail below. In the illustrated embodiments, separate sections of conveyor 34, each driven by their own respective motor 35, are used to move the carton 20 from the initial position A to the lid removal station B, to the goods removal station C.

Initial Position A

Carton 20 is loaded into apparatus 10 at position A (FIG. 7). This may be completed manually from a pallet of stacked cartons 20 or loaded by machine. Carton 20 may wait in the initial position until lid removal station B is free and the carton can be advanced forwardly to the lid removal station B (see FIG. 7).

Lid Removal Station B

In moving carton 20 toward station B, the carton 20 comes into contact with slitters 12*a* which slit along a long side of the carton 20. The position of slitters 12*a* can be seen in FIG. 7. Slitters 12*a* are fixed in position and include spring loaded blades that follow the contour of the carton 20, thereby accommodating any misalignment of the carton 20 on the conveyor 34, or bulging of side walls of the carton 20 due to the weight of the goods or freezing. In alternative embodiments, slitters 12*a*, 12*b* take other forms such as rotary knives for example.

When the carton moves to station B, it may come into contact with stops or guides to ensure consistent positioning upon arrival.

When carton 20 is at the lid removal station B, lid removal module 14 advances toward the carton 20 to remove the lid 24. The lid removal module 14 moves along path Y, as shown in FIG. 7, which is perpendicular to the path of movement X of the carton.

Figure 12:
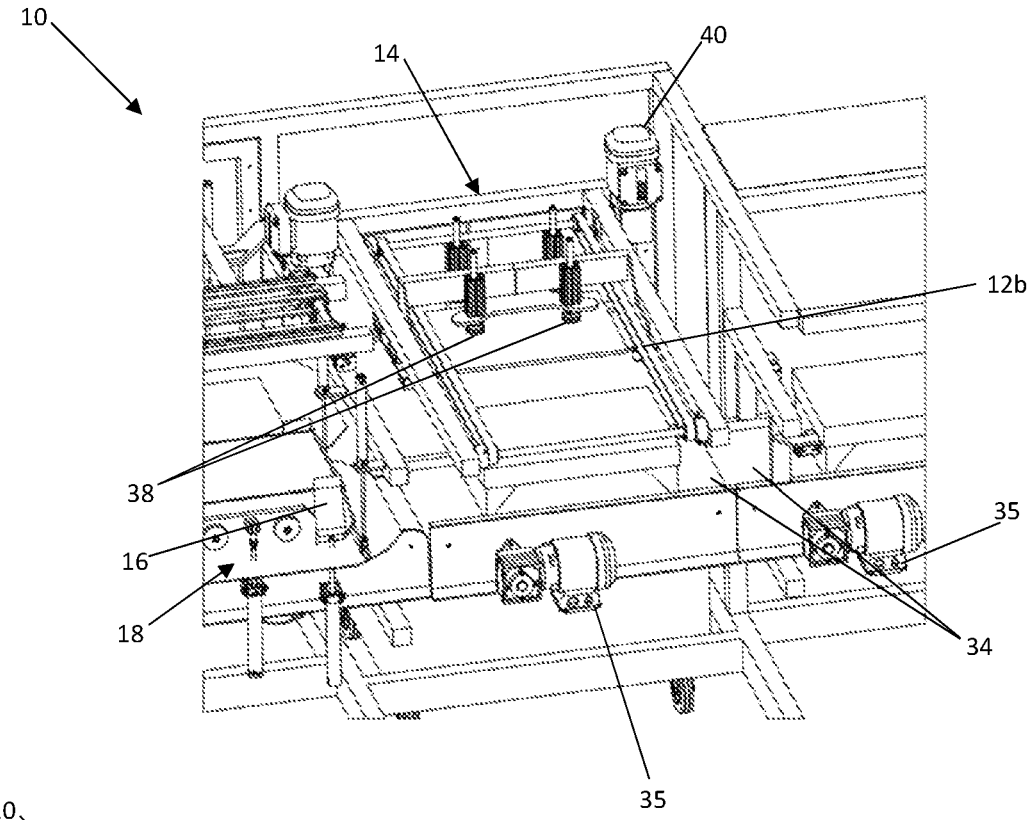
FIG. 12 is a perspective view of a lid removal station, with some parts removed for clarity.
Figure 13:
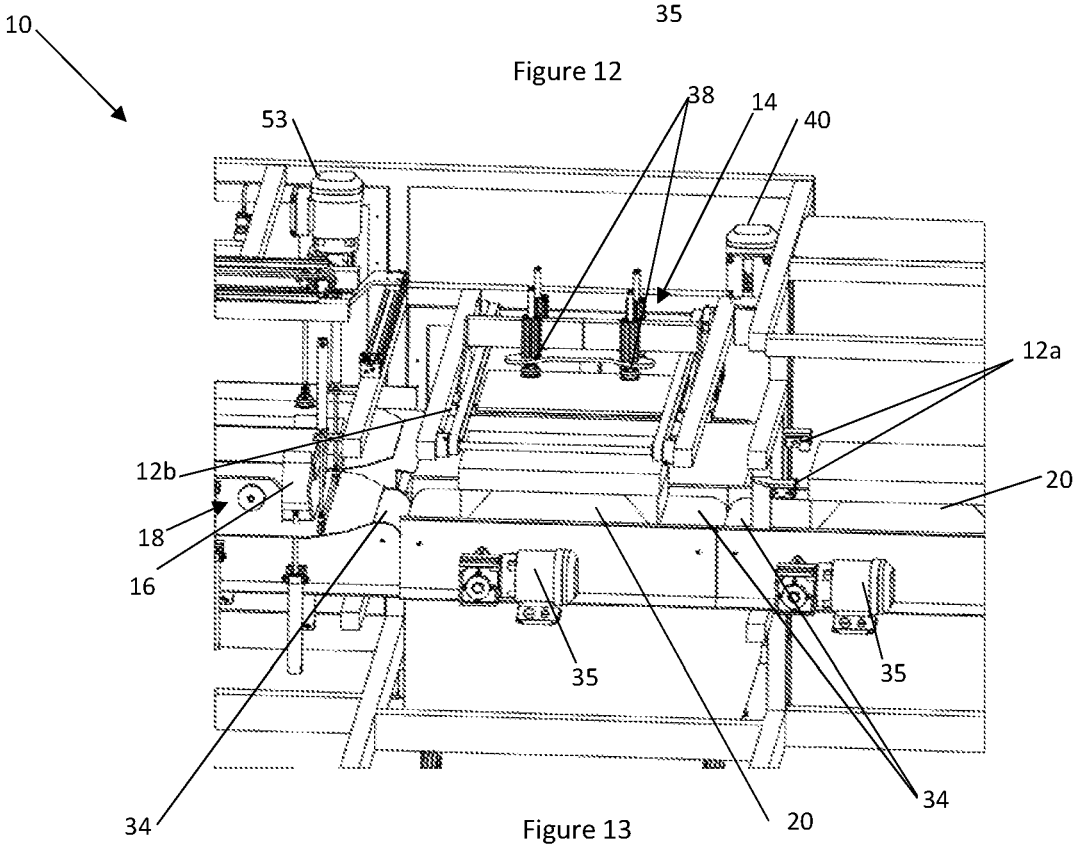
FIG. 13 is another perspective view of the lid removal station, with some parts removed for clarity.
Figure 14:
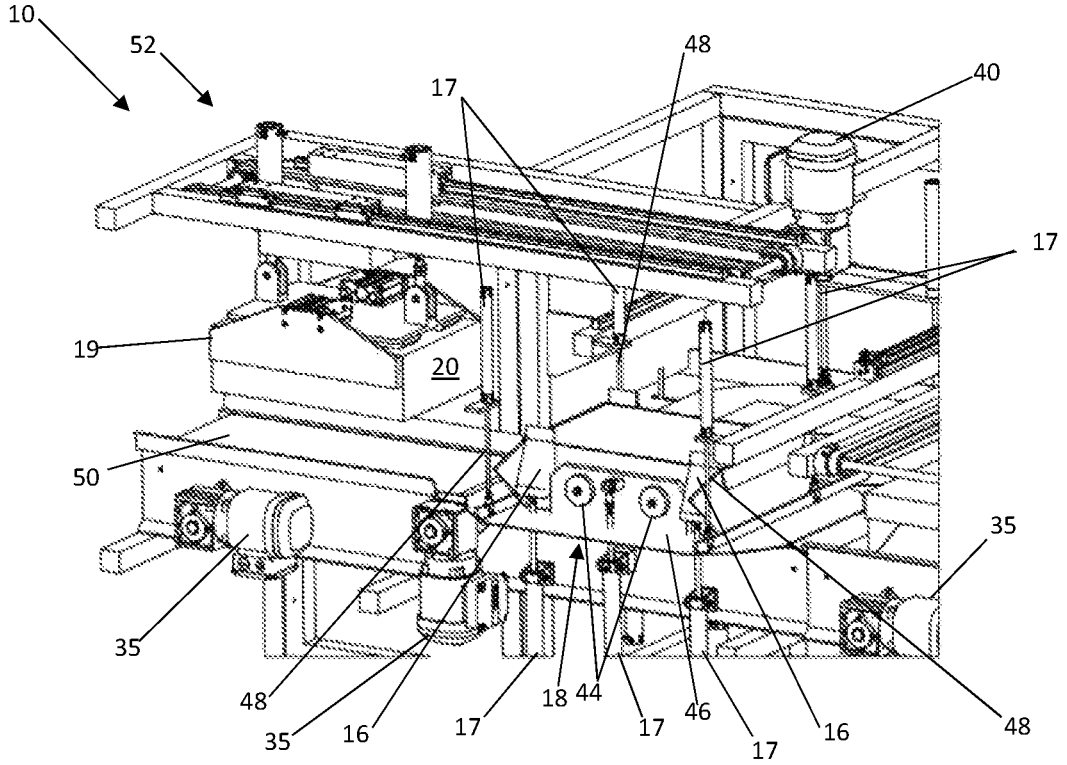
FIG. 14 is a perspective view of a goods removal station, with some parts removed for clarity.
Figure 15:
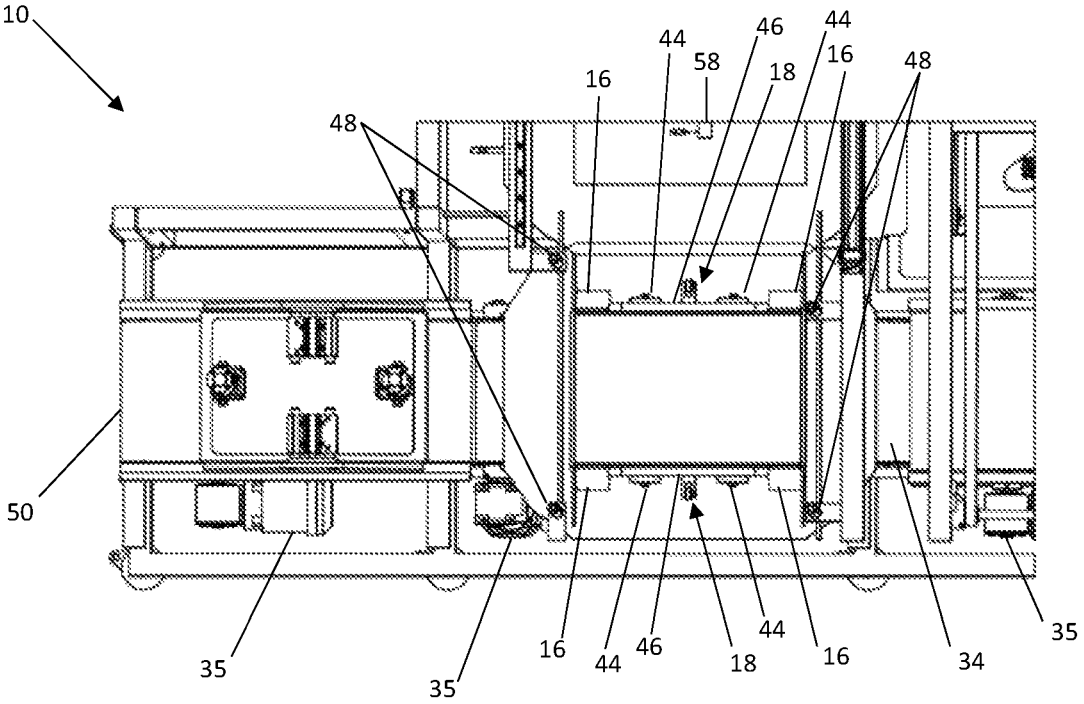
FIG. 15 is a close plan view of the goods removal station, with some parts removed for clarity.

As can be seen in FIGS. 12 and 13, the lid removal module 14 has slitters 12*b* fitted thereto, which move across the short sides of carton 20 as it sits at the lid removal station B, to complete slitting of the lid 24 to allow removal from the carton 20.

Each of slitters 12*a*, 12*b* cut through the flaps 26 of the lid 24 and partially into the folded down upper portions 30 of the base 22. The slits are made to an upper portion of the flaps 26 so as to be above a glue line which fixes the lid 24 to the base 22, thereby allowing the lid 24 to be removed from base 22 after cutting.

The lid removal module 14 engages the lid 24 to remove it from the carton 20. Once engaged, the lid removal module 14 lifts the lid 24 from the carton 20 and retracts away from the carton 20 along path Y so that the lid 24 can be dropped into a bin 36 (FIGS. 4, 5 and 10) for disposal. Bin 36 is preferably provided with wheels so that it can be interchanged with another like bin when full. A distance sensor within bin 36 may be provided to detect when the bin is full or approaching full. Alternatively, for high volume environments a conveyor or autonomous vehicle may be provided for transporting removed lids 22 from the apparatus 10.

In the lid removal module 14 shown in FIGS. 12 and 13, suction cups 38 are used to engage the lid, though it will be appreciated that other forms of engagement, such as grippers or spikes may also be used.

In the illustrated embodiments, four suction cups 38 are used, each one being positioned near a corner of the lid 24, though it will be appreciated that less than or more than four suctions cups may also be used.

The lid removal module 14 runs on tracks and belts driven by electric motor 40, though it will be appreciated that other mechanisms and types of drives may be used.

Goods Removal Station C

Once lid 24 has been removed from carton 20, and goods removal station C (FIG. 7) is free, the carton 20 is moved from station B to station C, where the goods are removed from the carton 20.

Once in position, expansion members 16 are driven upwardly from below carton 20 by pneumatic cylinders 17 and received between the gussets 32 and the external side faces of the side walls 28 of the carton 20 to remove the gussets 32 from the side faces. It will be appreciated that in alternative embodiments, the expansion members 16 may also be driven downwardly from above the carton 20.

To ensure that the carton 20 is positioned so that the expansion members 16 can accurately be driven between the gussets 32 and the side walls 28, a guide or stop may be provided to position the carton 20 as required. Alternatively, clamps may also be used to move and hold the carton 20 in position.

In the illustrated embodiments, the expansion members 16 are in the form of solid wedges, though they make take other forms. For example, the expansion members 16 may be plates hinged together at one end and separable at the other end to form wedges in an expanded state. In other forms, the expansion members may be hooks that hook under the gussets 32 and allow the gussets 32 to be drawn away from the external side faces of the side walls 28.

By providing wedges in the preferred embodiments, the gussets 32 can be gently detached from the external side faces of the side walls 28, without damaging the gussets 32 or the carton 20. Detaching the gussets 32 can be difficult, particularly if the carton 20 is damp or soggy, in which case it may tear easily.

Figure 9:
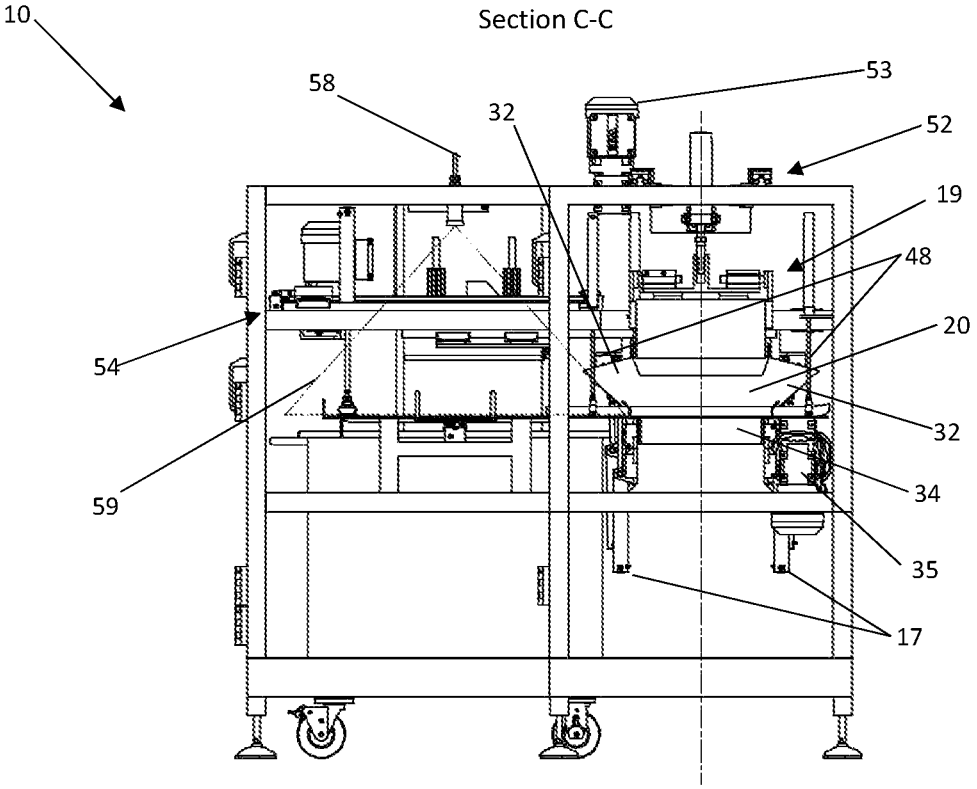
FIG. 9 is an end view of the apparatus.
Figure 10:
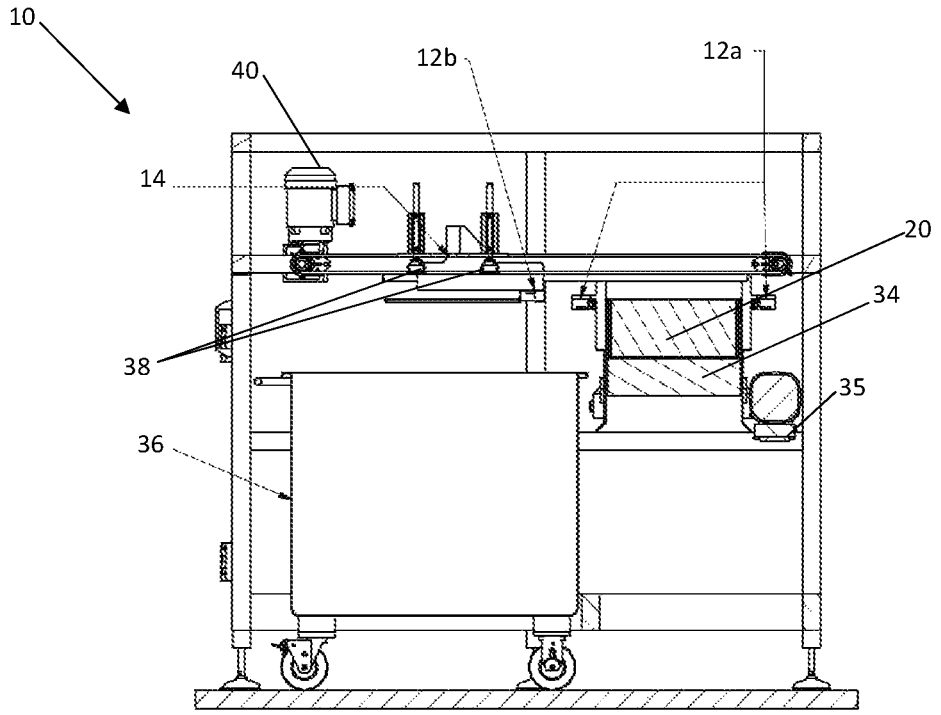
FIG. 10 is a section view of the apparatus, showing a section taken along line A-A of FIG. 5.
Figure 11:
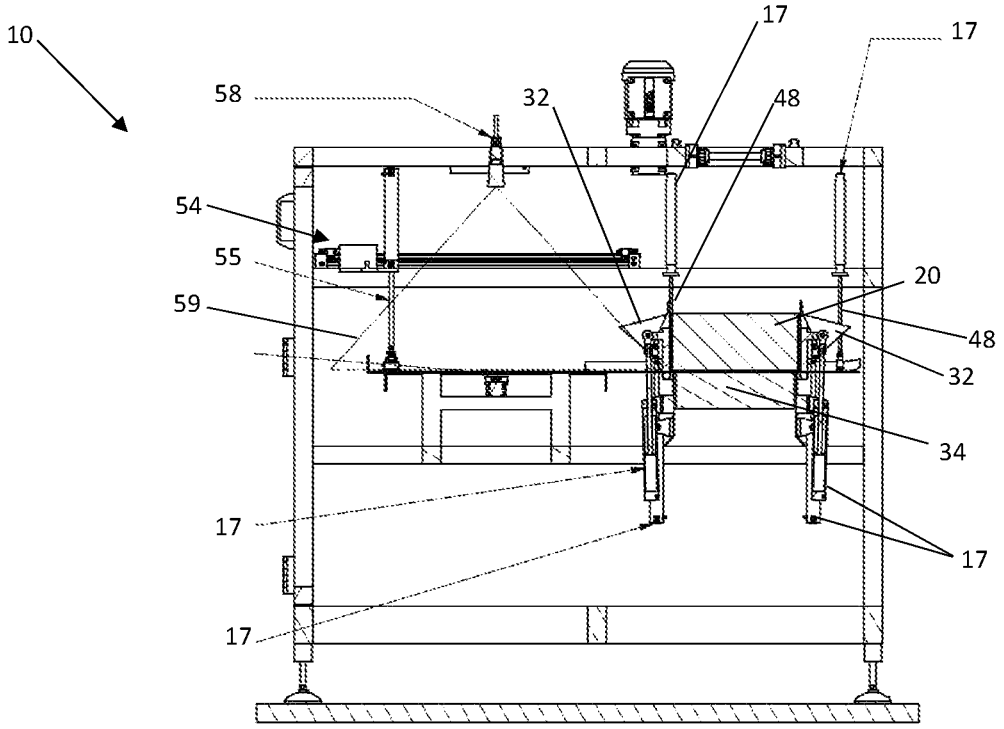
FIG. 11 is a section view of the apparatus, showing a section taken along line B-B of FIG. 5.

Once the gussets 32 have been detached from the carton 20, as shown in FIGS. 9 and 11, engagement members 18 (FIGS. 5, 6, 7, 12, 13 and 15) are used to engage the long side walls 28 of the base 22 and draw them away from the goods. Engagement members 18 are driven upwardly by pneumatic cylinders 17.

In one embodiment, the engagement members 18 includes suction cups 44 configured to engage the side walls 28 of the carton 20. Suction cups 44 are mounted in plates 46. In the illustrated embodiments, the plates 46 are hinged and swing downwardly to draw the side walls 28 away from the goods and hold them in a generally horizontal position while the goods are removed from the carton. Multiple, spaced apart suction cups are used to ensure sufficient engagement with the side walls 28.

Once the long side walls 28 are drawn away from the goods and held down, the short side walls are then required to be drawn away from the goods and held down. Suction cups may be used for this function also, though in the illustrated embodiment, rods 48 are used and advanced downwardly from above the carton 20 to engage the side walls 28, draw them downwardly and away from the goods, and pin them to the conveyor belt 34 while the goods are removed from the carton 20.

Rods 48 may move sequentially or together and may be driven by linear actuators or pneumatically.

To assist with removal of the goods from the carton 20, once the gussets 32 are detached or released from the side of the carton 20, they may be engaged and pulled outwardly to disengage an inner surface of the side walls 28 from the goods.

Once the side walls 28 have been drawn away from the goods and held in position, the goods can be removed from the carton 20. To this end, the goods transfer module 19 engages the goods and lifts them from the carton 20 and transports the goods to an exit conveyor 50.

In the illustrated embodiments, the goods transfer module 19 includes fingers or spikes configured to pierce the goods for engagement thereof. Fingers or spikes are used as the goods may be a frozen block of meat, which is typically irregular in shape and can be difficult to grip. Preferably, the fingers or spikes are formed of stainless steel. It will be appreciated that in other embodiments, the goods transfer module 19 may include grippers or other means for lifting the goods from the carton 20.

The module 19 travels on a carriage 52 driven by motor 53, and is configured to lift the goods before moving them to the exit conveyor 50, which is a food contact surface. In preferred embodiments, the module 19 is provided with some float and configured to slightly twist or tilt the goods during lifting to release them from the carton, starting at one corner. This may break adhesion and minimise adhesion resistance forces and can assist in the goods coming away from the carton 20 in a single continuous block without breaking up.

Once the goods are removed from the carton 20, the empty carton is transported by a transfer module 54 in a direction perpendicular to direction X, towards a bin 56 for disposal. The transfer module 54 may engage the empty carton via a suction cup 55.

Figure 5:
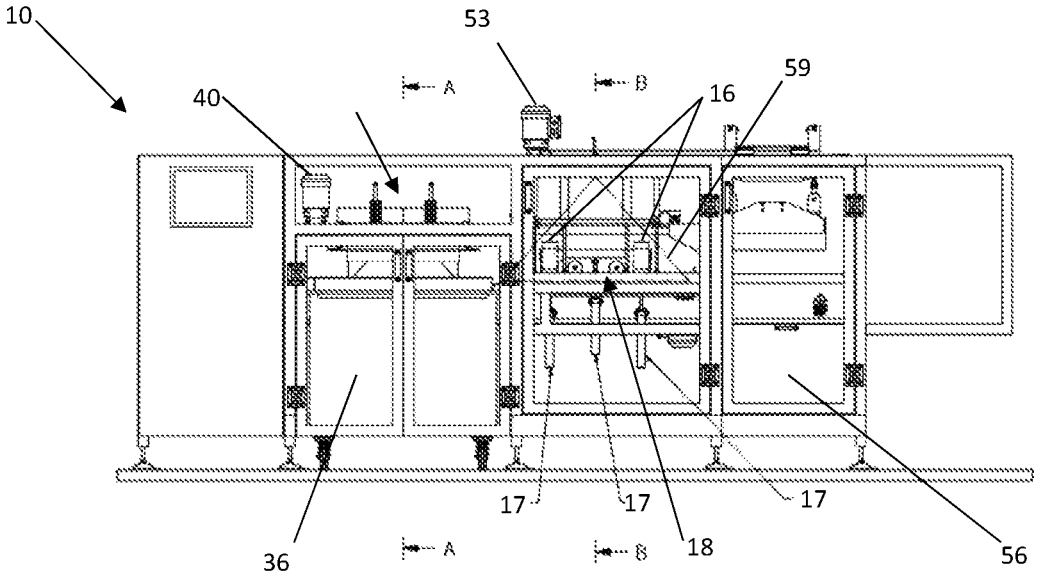
FIG. 5 is a rear view of the apparatus.
Figure 6:
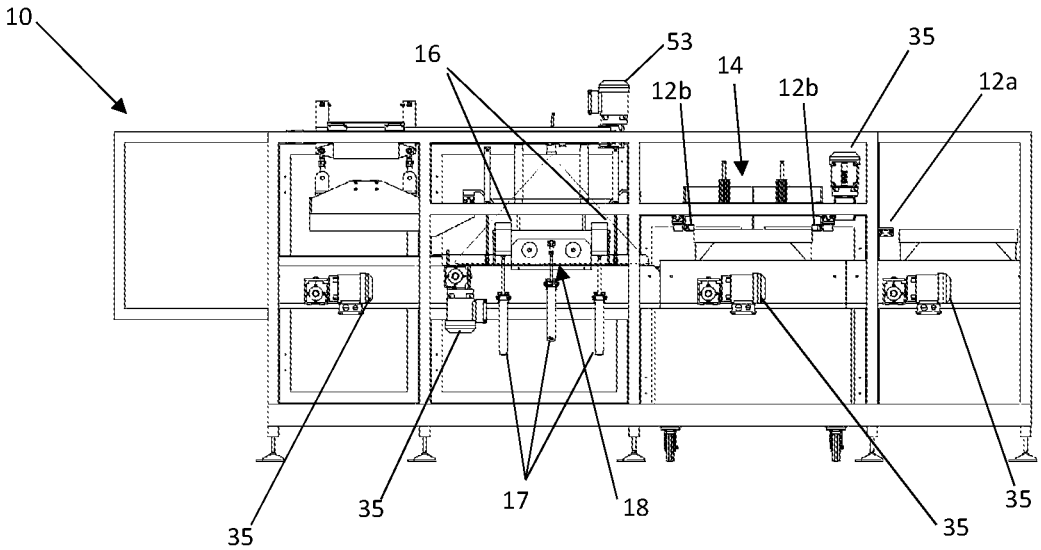
FIG. 6 is a front view of the apparatus.

Alternatively, the empty carton 20 may be dragged across to bin 56 (FIG. 5).

By holding the carton in place and moving the goods away from the carton, any contamination on the external surface of the carton can be kept away from the goods.

An imaging system or optical scanning system including a camera or optical scanner 58 may be provided for scanning an internal surface of the base 22 of the carton 20 once the goods are removed. The extent of the area scanned by the camera/optical scanner is shown in the drawings as item 59.

The imaging system may include a conventional camera for taking a digital photograph or an infra-red camera. Alternative imaging systems such as X-ray systems may also be used.

A second camera/optical scanner may be provided at station B for scanning the lid 24 of the carton 20 once removed. The lid 24 is preferably scanned from underneath.

The imaging/optical scanning system is configured to verify that the carton is intact and that there are no carton fragments are missing, which could be attached to the goods. However, verification that the goods are free from carton contamination can only be done by checking the goods. To obtain such verification, the imaging/optical scanning system may be configured to scan the goods directly. It will be appreciated that the imaging/optical scanning system may scan only the carton or the goods, or scan both the carton and the goods. In the event that any fragments are detected as missing from the carton, the apparatus 10 may be configured to stop or to automatically quarantine the potentially affected goods for further inspection.

In use, the captured images may be processed electronically by a processor, or manually via an operator. If an operator is used, a number of photos may be queued or displayed together on a display screen to be reviewed at the same time. Preferably, the goods are indexed or sequenced for easy matching in the event that the scanning system identifies goods or carton bases 22 or lids 24 that require further inspection. In some embodiments, a food grade dye may be applied to the goods and/or bases 22/lids 24 to flag that further inspection is necessary.

Although not shown, it will be appreciated that the apparatus 10 can include other components for safe and reliable function, such as safety guards and cut-off switches and controls, all of which may be controlled via a main control cabinet 60.

Apparatus 10 is configured for use in a food processing environment and to meet relevant food processing standards, meeting wash down requirements etc.

The embodiments have been described by way of example only and modifications are possible within the scope of the invention disclosed. For example, the described pneumatic actuators may be substituted with electrical actuators or mechanical linkages. Instead of conveyors, the carton 20 may be pushed along a roller surface and engagement of the goods for removal of the carton may be performed in other ways.

Preferred embodiments of the invention can provide an automated apparatus for removing goods from a two-part carton, potentially reducing cycle times over manual operations and saving labour costs. When used to remove frozen goods, the number of people operating in a low temperature environment can be reduced. Also, additional steps previously taken to reduce adhesion between the goods and the carton, such as increasing the temperature of the goods either when stored or by microwaving, can be avoided.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

REFERENCE NUMERALS

10 Apparatus for removing goods from a two-part carton
12*a*, 12*b* Slitters
14 Lid removal module
16 Expansion members
17 Pneumatic cylinders
18 Engagement members
19 Goods transfer module
20 Two part carton
22 Base of carton
24 Lid of carton
26 Flaps of lid
28 Side walls of base of carton
30 Externally folded down upper portions of side walls
32 Gussets of base of carton
34 Conveyor belt
35 Conveyor belt motor
36 Bin for disposal of carton lids
38 Suction cups
40 Motor
42 Side wall engagement members
44 Suction cups of engagement members 18
46 Plates
48 Rods
50 Exit conveyor
52 Carriage

53 Motor
54 Transfer module
55 Suction cup
56 Bin
58 Camera/Optical scanner
59 Extent of optical scanner
60 Main control cabinet

The invention claimed is:

1. An apparatus for removing goods from a two-part carton having a base and a lid, the base being formed with side walls having external gussets secured against external side faces of the carton, the apparatus including:

a lid removal module configured for engaging the lid and removing the lid from the carton;

expansion members configured to be advanced between the gussets and the external side faces of the carton to remove the gussets from the side faces;

engagement members configured for engaging the side walls of the base and drawing the side walls of the base away from the goods and holding the side walls of the base in a position away from the goods; and a goods transfer module configured for engaging the goods and removing the goods from the carton;

wherein the engagement members include rods that extend downwardly to engage a second pair of side walls of the carton to draw second pair of side walls away from the goods, the rods being configured to pin the second pair of side walls against a transfer conveyor.

2. The apparatus of claim 1, wherein the expansion members are wedges driven upwardly from below the carton.

3. The apparatus of claim 1, wherein the engagement members include suction cups configured to engage a first pair of side walls of the carton, the first pair of side walls of the carton being generally parallel with a path of travel of the carton.

4. The apparatus of claim 1, further including at least one conveyor belt for transporting the carton through the apparatus, the at least one conveyor belt being configured to move the carton between an initial position, a lid removal station, and a goods removal station, wherein slitters are configured to contact the first pair of sidewalls of the carton during movement of the carton from the initial position to the lid removal station, and wherein the slitters are configured to contact the second pair of side walls of the carton when the carton is positioned at the lid removal station.

5. The apparatus of claim 4, wherein the slitters are fixed to the lid removal module.

6. The apparatus of claim 1, further including an imaging system configured for scanning at least one of (a) the goods, (b) an internal surface of the base of the carton, and (c) the lid of the carton once the goods are removed from the carton, the imaging system being further configured to identify missing carton fragments that may be attached to the goods.

7. An apparatus for removing goods from a two-part carton having a base and a lid, the lid being formed with flaps extending downwardly therefrom, and the base being formed with side walls having externally folded down upper portions and external gussets secured against external side faces of the carton, wherein the flaps of the lid are secured to the folded down upper portions of the base, the apparatus including:

slitters configured for cutting along sides of the carton to cut through the flaps of the lid and partially into the folded down upper portions of the base;

a lid removal module configured for removing the lid from the carton;

expansion members configured to be advanced between the gussets and the external side faces of the carton to remove the gussets from the side faces;

engagement members configured for engaging the side walls of the base and drawing the side walls of the base away from the goods and holding the side walls of the base in a position away from the goods; and a goods transfer module configured for engaging the goods and removing the goods from the carton;

wherein the engagement members include rods that extend downwardly to engage a second pair of side walls of the carton to draw second pair of side walls away from the goods, the rods being configured to pin the second pair of side walls against a transfer conveyor.

8. The apparatus of claim 7, wherein the expansion members are wedges driven upwardly from below the carton.

9. The apparatus of claim 7, wherein the engagement members include suction cups configured to engage a first pair of side walls of the carton, the first pair of side walls of the carton being generally parallel with a path of travel of the carton.

10. The apparatus of claim 7, wherein the goods transfer module is configured to tilt the goods to release the goods from the carton.

11. The apparatus of claim 7, further including at least one conveyor belt for transporting the carton through the apparatus, the at least one conveyor belt being configured to move the carton between an initial position, a lid removal station, and a goods removal station, wherein the slitters are configured to contact the first pair of sidewalls of the carton during movement of the carton from the initial position to the lid removal station.

12. The apparatus of claim 11, wherein the slitters are configured to contact the second pair of side walls of the carton when the carton is positioned at the lid removal station.

13. The apparatus of claim 12, wherein the slitters are fixed to the lid removal module.

14. The apparatus of claim 7, further including an imaging system configured for scanning at least one of (a) the goods, (b) an internal surface of the base of the carton, and (c) the lid of the carton once the goods are removed from the carton, the imaging system being further configured to identify missing carton fragments that may be attached to the goods.

15. A method of removing goods from a two-part carton having a base and a lid, the lid being formed with flaps extending downwardly therefrom and the base being formed with side walls having folded down upper portions and external gussets secured against external side faces of the carton, the method including the steps of:

(a) slitting sides of the carton to cut through the flaps of the lid and partially into the folded down upper portions of the base;

(b) removing the lid;

(c) driving expansion members between the gussets and the side faces to remove the gussets from the side faces;

(d) drawing the side walls of the base away from the goods; and (e) engaging the goods to remove the goods from the carton;

further including, after the goods have been removed from the carton, the step of (f) scanning at least one of (i) the goods, (ii) an internal surface of the base of the carton, and (iii) the lid to check for missing carton fragments.

16. The method of claim 15, wherein engaging the goods includes tipping the goods to release the goods from the carton.

17. The method of claim 16, wherein the expansion members are wedges driven upwardly from underneath the carton.

* * * * *